US011196213B2

(12) United States Patent
Shen et al.

(10) Patent No.: US 11,196,213 B2
(45) Date of Patent: Dec. 7, 2021

(54) CABLE END CONNECTOR

(71) Applicant: Dongguan Luxshare Technologies Co., Ltd, Dongguan (CN)

(72) Inventors: XueHai Shen, Dongguan (CN); RongZhe Guo, Dongguan (CN); HongJi Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/031,379

(22) Filed: Sep. 24, 2020

(65) Prior Publication Data

US 2021/0336385 A1 Oct. 28, 2021

(30) Foreign Application Priority Data

Apr. 24, 2020 (CN) ..... 202010335251.0

(51) Int. Cl.
*H01R 13/506* (2006.01)
*H01R 13/627* (2006.01)
*H01R 13/629* (2006.01)

(52) U.S. Cl.
CPC ..... *H01R 13/6271* (2013.01); *H01R 13/506* (2013.01); *H01R 13/629* (2013.01)

(58) Field of Classification Search
CPC ..... H01R 13/6271; H01R 13/506; H01R 13/629; H01R 13/6275
See application file for complete search history.

(56) References Cited

U.S. PATENT DOCUMENTS 6,830,478 B1 * 12/2004 Ko ..... H01R 13/6275 439/579
6,890,205 B1 * 5/2005 Wu ..... H01R 13/6275 439/108
7,467,953 B2 * 12/2008 Kuo ..... H01R 12/592 439/484

(Continued)

FOREIGN PATENT DOCUMENTS

CN 209266665 U 8/2019
TW M565419 U 8/2018
TW M600949 U 9/2020

*Primary Examiner* — Tho D Ta
(74) *Attorney, Agent, or Firm* — Birch, Stewart, Kolasch & Birch, LLP

(57) ABSTRACT

The present disclosure provides a cable end connector comprising a plugging member, a plurality of cables, an insulating body, a latch component, and two positioning bumps. The insulating body comprises a plugging surface, a first surface and a connecting surface. The plugging member protrudes from the plugging surface. One ends of the plurality of cables pass through the connecting surface. The first surface comprises a latch accommodating groove comprising a buckling hole. The latch component is disposed in the latch accommodating groove. The latch component comprises a first latch plate and a second latch plate opposite to the first latch plate. The first latch plate comprises a buckling elastic sheet. The buckling elastic sheet is disposed in the buckling hole. The second latch plate comprises a buckling bump. The two positioning bumps are oppositely disposed on the plugging surface and are disposed on a side edge of the plugging surface.

16 Claims, 6 Drawing Sheets

(56) References Cited

U.S. PATENT DOCUMENTS

| | | | | |
|---|---|---|---|---|
| 8,870,586 | B2 * | 10/2014 | Wang | H01R 13/6275 439/358 |
| 10,236,605 | B1 * | 3/2019 | Henry | H01R 12/732 |
| 10,741,970 | B1 * | 8/2020 | Liu | H01R 13/6275 |
| 2004/0166717 | A1 * | 8/2004 | Muro | H01R 13/6272 439/358 |
| 2008/0318462 | A1 * | 12/2008 | Gerard | H01R 13/6275 439/353 |
| 2009/0004896 | A1 * | 1/2009 | Gerard | H01R 13/6275 439/95 |
| 2010/0221939 | A1 * | 9/2010 | Fakhri | H01R 13/6275 439/153 |
| 2018/0205179 | A1 | 7/2018 | Zhou et al. | |
| 2020/0403330 | A1 * | 12/2020 | Liao | H01R 12/57 |

* cited by examiner

CABLE END CONNECTOR

CROSS REFERENCE TO RELATED APPLICATION

This application claims the priority benefit of Chinese Patent Application Serial Number CN202010335251.0, filed on Apr. 24, 2020, the fill disclosure of which is incorporated herein by reference.

BACKGROUND

Technical Field

The present disclosure relates to the technical field of connector, particularly to a cable end connector.

Related Art

Conventional cable end connector generally includes a connector body and a latch. The latch is usually disposed on the top surface of the connector body. The cable end connector is connected to the board end connector through the latch. The latch is buckled to the board end connector through a buckling component. In general, the corresponding buckling component between the latch and the connector body is that, to excavate a part of the latch body for a buckling hole. The connector body is provided with a bump corresponding to the buckling hole. Thus, the latch can be secured to the connector body by mating the bump with the buckling hole. However, the latch tends to detach from the connector body in such configuration, presenting poor connect stability. On the other hand, a guiding member is usually provided on the periphery of the connector body, which guides the board end connector to connect with the cable end connector. However, as the guiding member is disposed on the periphery of the connector body, the size of the cable end connector is correspondingly increasing.

SUMMARY

The embodiments of the present disclosure provide a cable end connector to solve the problem of poor connect stability of the latch, of which the cable end connector in the prior art is only buckled to the board end connector.

The embodiments of the present disclosure provide a cable end connector comprising a plugging member, a plurality of cables, an insulating body, a latch component, and two positioning bumps. The plugging member comprises a plurality of contacting pads disposed on one side of the plugging member. One ends of the plurality of cables are disposed at the other ends of the plugging member. The plurality of cables are electrically connected to the corresponding contacting pads respectively. The insulating body comprises a plugging surface, a first surface, and a connecting surface. The first surface is orthogonal to the plugging surface. One end of the plugging member having the plurality of contacting pads protrudes from the plugging surface. The other ends of the plurality of cables pass through the connecting surface. The first surface comprises a latch accommodating groove. The latch accommodating groove comprises a buckling hole. The latch component is disposed in the latch accommodating groove. The latch component comprises a first latch plate and a second latch plate opposite to the first latch plate. The first latch plate is adjacent to the bottom surface of the latch accommodating groove. The first latch plate comprises a buckling elastic sheet. The buckling elastic sheet projects in a direction away from the second latch plate. The buckling elastic sheet is disposed in the buckling hole. The second latch plate comprises a buckling bump disposed on a surface of the second latch plate away from the first latch plate. The two positioning bumps are oppositely disposed on the plugging surface. Each of the two positioning bumps is disposed on a side edge of the plugging surface.

The embodiments of the present disclosure could increase the connect stability of the latch component by buckling the buckling elastic sheet of the first latch plate with the buckling hole of the insulating body and by buckling the buckling bump of the second latch plate with the board end connector, achieving a firm tow-way buckling. In addition, by disposing two positioning bumps on the plugging surface mating with the board end connector, the two positioning bumps are disposed on the inner side edge of the plugging surface. Therefore, the surface area that the cable end connector mates with the board end connector could be maintained unexceeding the area of the plugging surface of the insulating body, which limits the increase of the volume of the cable end connector.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
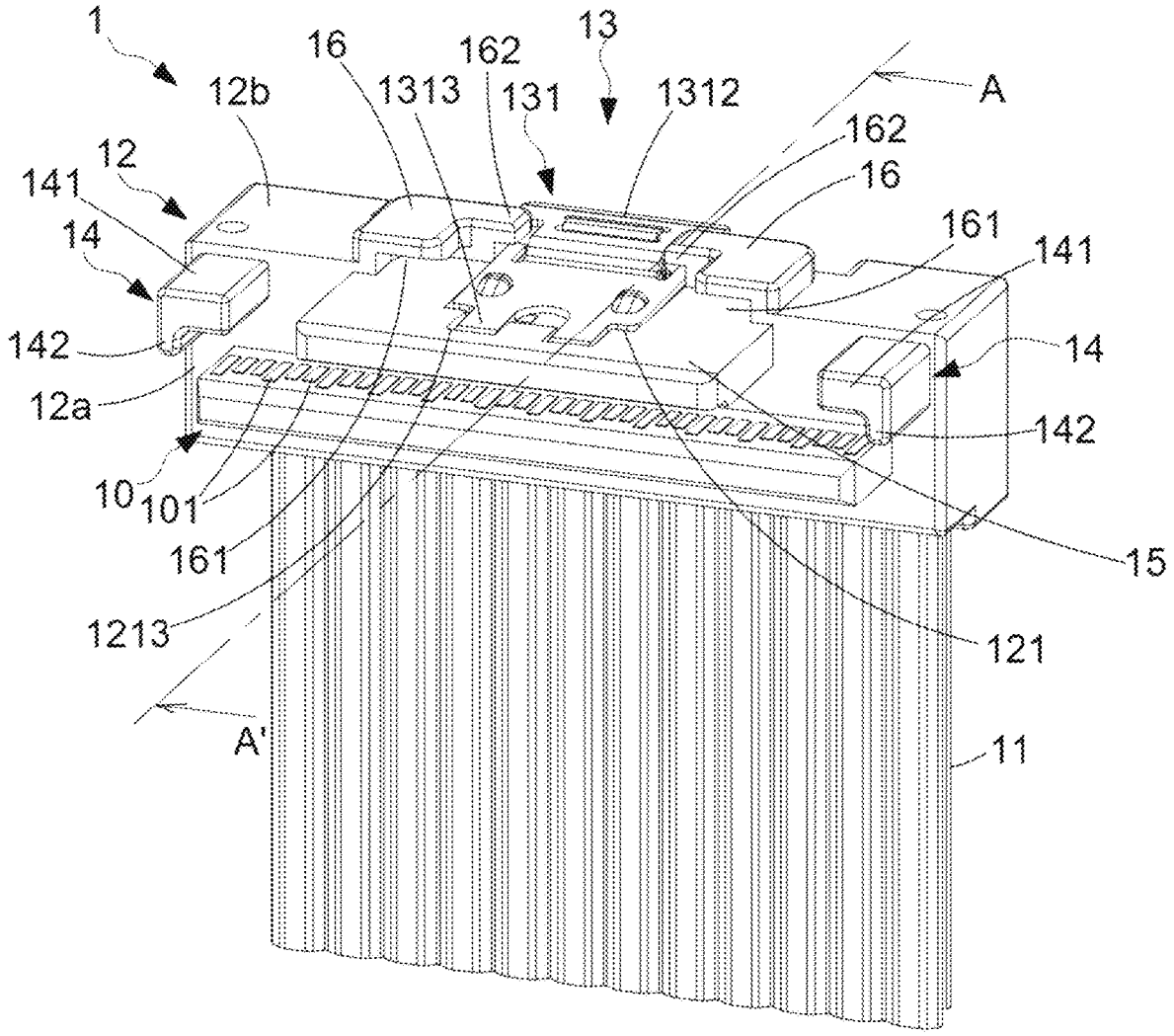
FIG. 1 is a perspective view of a cable end connector of one embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
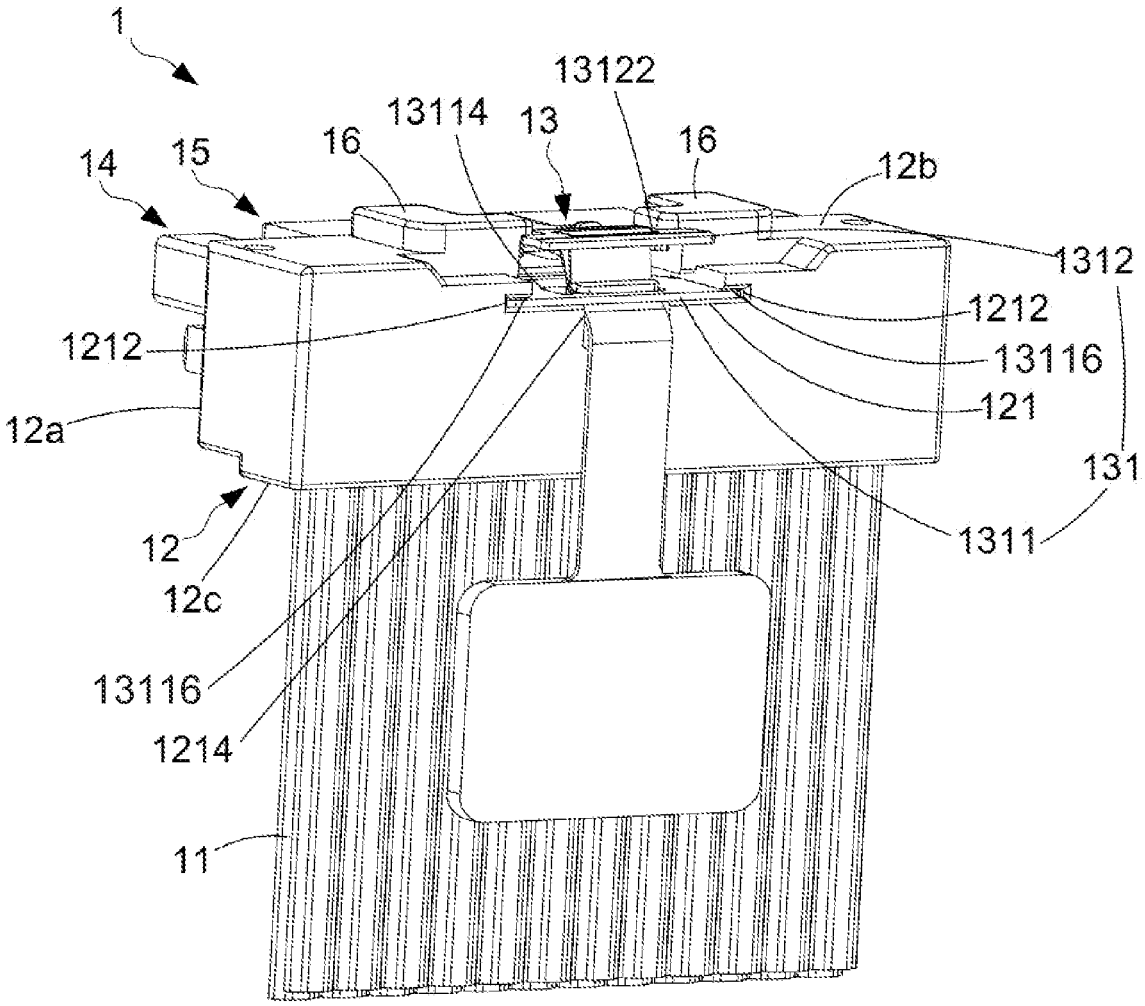
FIG. 2 is another perspective view of the cable end connector of one embodiment of the present disclosure.
Figure 3:
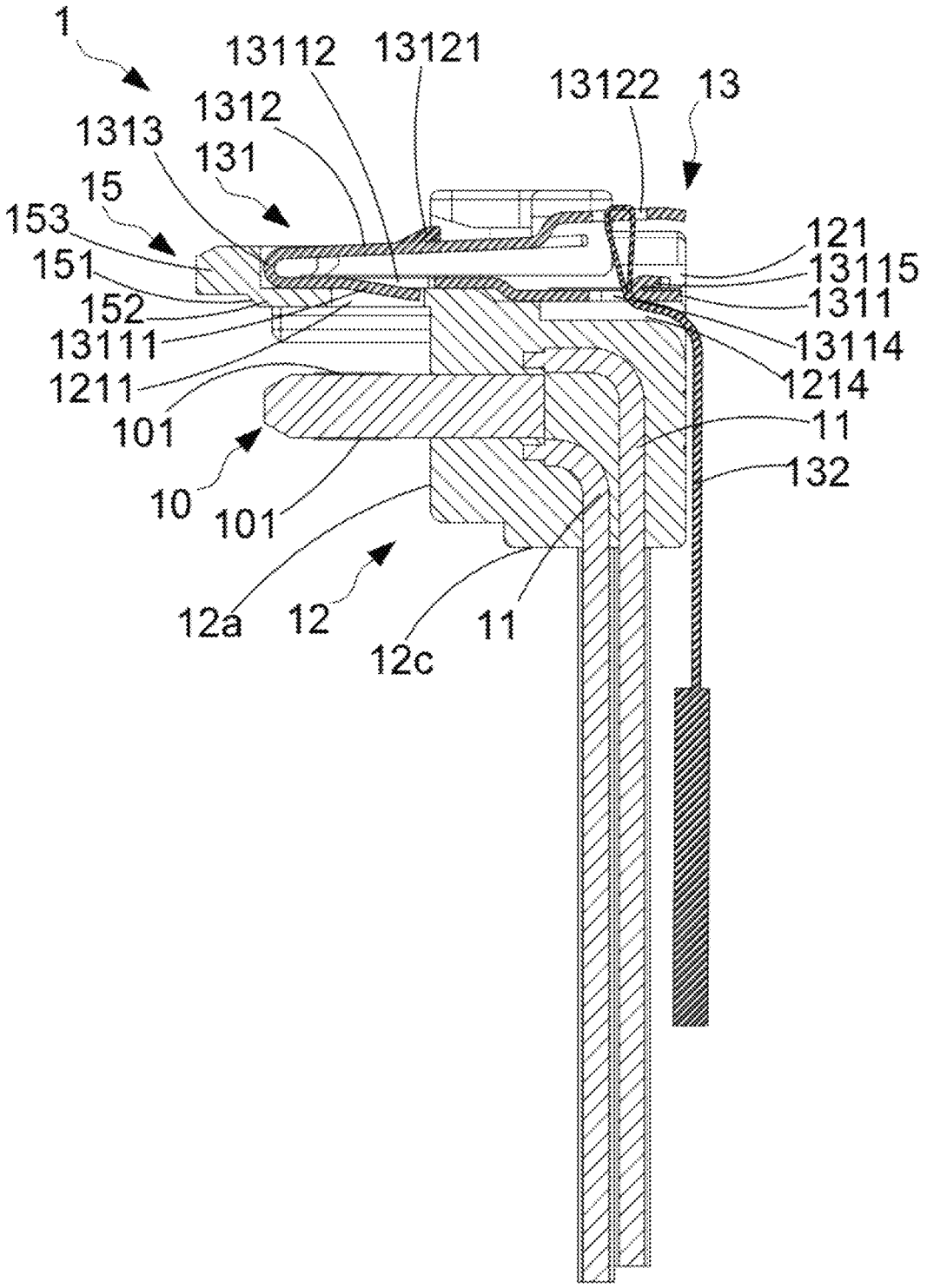
FIG. 3 is a cross-sectional view along line A-A' in FIG. 1.

FIG. 1 and FIG. 2 are perspective views of the cable end connector of one embodiment of the present disclosure. FIG. 3 is a cross-sectional view along line A-A' in FIG. 1. As shown in the figure, the cable end connector 1 of this embodiment comprises a plugging member 10, a plurality of cables 11, an insulating body 12, and a latch component 13. The plugging member 10 comprises a plurality of contacting pads 101 disposed on two opposite surfaces of the plugging member 10 and is disposed at one end of the plugging member 10. One end of the plurality of cables 11 is disposed on the other end of the plugging member 10 and is respectively electrically connected to the corresponding contacting pad 101. The insulating body 12 is disposed on the plugging member 10 and the plurality of cables 11. The insulating body 12 is inject-molded onto the plugging member 10 and the plurality of cables 11 to cover the connecting point between the plurality of cables 11 and the plugging member 10. The insulating body 12 comprises a plugging surface 12*a*, a first surface 12*b*, and a connecting surface 12*c*. The plugging surface 12*a* is orthogonal to the first surface 12*h*. One end of the plugging member 10 having the plurality of contacting pads 101 protrudes from the plugging surface 12*a* to expose the plurality of contacting pads 101. The other ends of the plurality of cables 11 pass through the connecting surface 12*c*. In this embodiment, the connecting surface 12*c* is opposite to the first surface 12*h*. The insulating body 12 comprises a latch accommodating groove 121 and is disposed on the first surface 12*b*.

Figure 4:
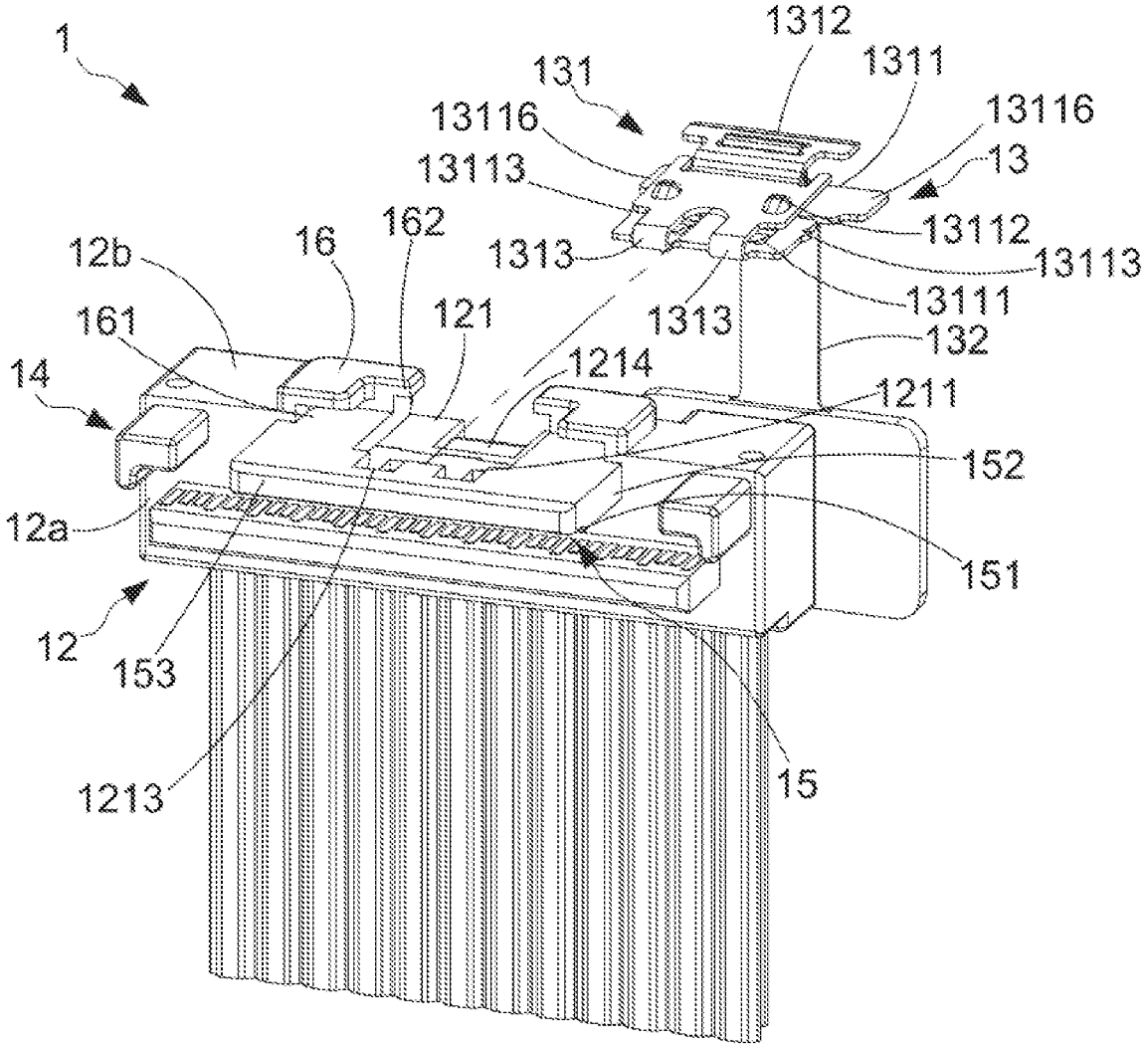
FIG. 4 is an exploded view of a cable end connector of one embodiment of the present disclosure.

FIG. 4 is an exploded view of a cable end connector of one embodiment of the present disclosure. As shown in the figure, the latch component 13 is disposed in the latch accommodating groove 121. The latch component 13 comprises a latch 131 and a puller 132 disposed at one end of the latch 131. The latch 131 is disposed in the latch accommodating groove 121. The puller 132 is disposed on one side of a surface of the insulating body 12 opposite to the plugging surface 12*a*. The latch 131 comprises a first latch plate 1311, a second latch plate 1312, and a bent connecting sheet 1313. The first latch plate 1311 is opposite to the second latch plate 1312. The bent connecting sheet 1313 is connected to one ends of the first latch plate 1311 and the second latch plate 1312. The second latch plate 1312 is bent relative to the first latch plate 1311. The puller 132 is disposed at one end of the second latch plate 1312 away from the bent connecting sheet 1313 and passes through one end of the first latch plate 1311 away from the bent connecting sheet 1313. When the latch 131 is disposed in the latch accommodating groove 121, the first latching plate 1311 is disposed adjacent to the bottom surface of the latch accommodating groove 121. The second latch plate 1312 is disposed above the first latch plate 1311. The bent connecting sheet 1313 is disposed on one side of the plugging surface 12*a*.

Figure 5:
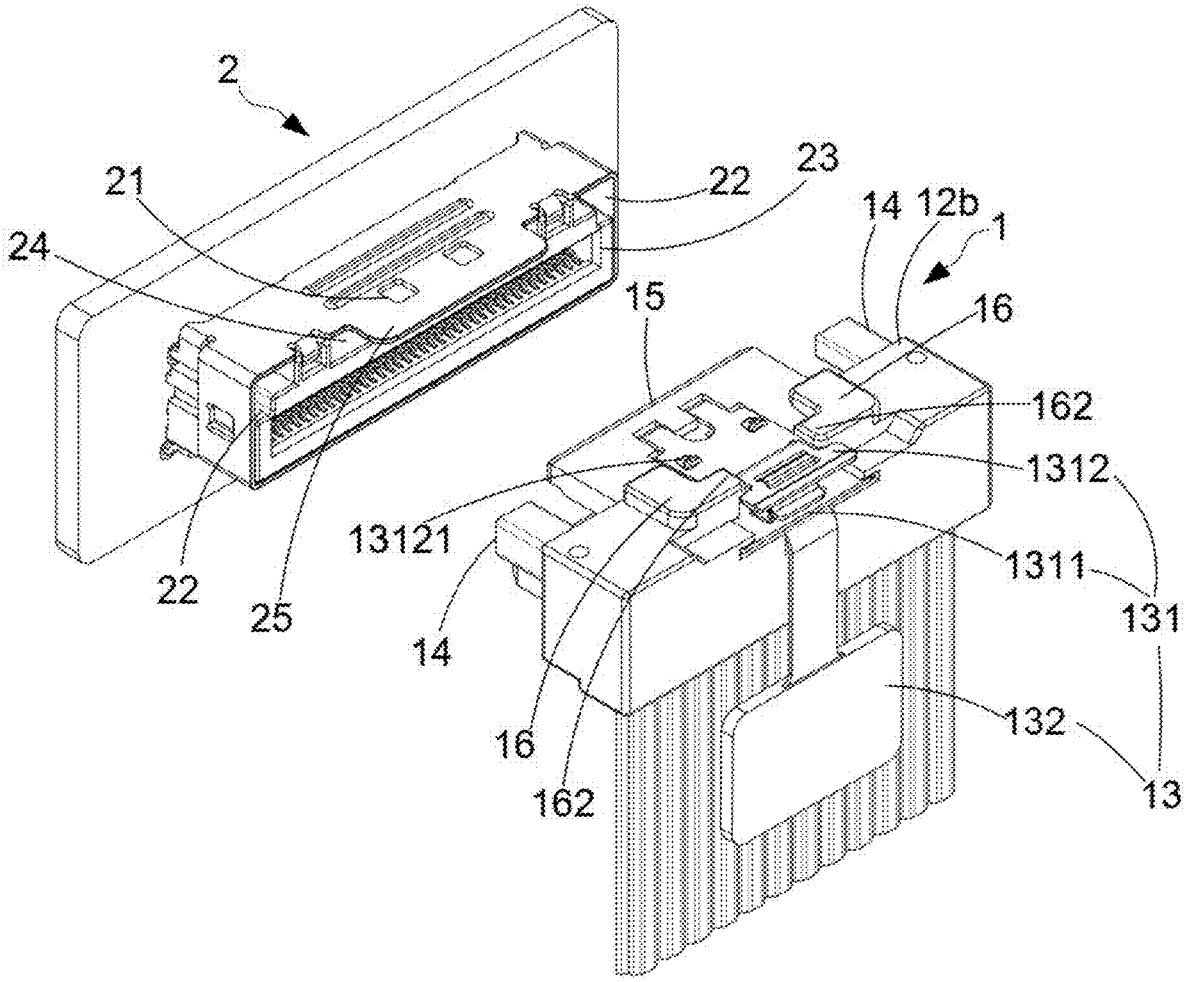
FIG. 5 is an usage state diagram of a cable end connector of one embodiment of the present disclosure.

The first latch plate 1311 comprises a buckling elastic sheet 13111. The buckling elastic sheet 13111 protrudes in a direction away from the second latch plate 1312 and extends in a direction away from the plugging surface 12*a*, The latch accommodating groove 121 comprises a buckling hole 1211 disposed on the bottom surface of the latch accommodating groove 121. When the latch 131 is disposed in the latch accommodating groove 121, the buckling elastic sheet 13111 of the first latch plate 1311 of the latch 131 is disposed in the buckling hole 1211. One end of the first latch plate 1311 away from the plugging surface 12*a* abuts against a sidewall of the buckling hole 1211 away from the plugging surface La to prevent the latch 131 from detaching from the latch accommodating groove 121 in a direction away from the plugging surface 12*a*. In this embodiment, the number of buckling elastic sheet 13111 is two, and the number of buckling hole 1211 equals to the number of buckling elastic sheet 13111. The second latch plate 1312 comprises a buckling bump 13121 disposed on a surface of the second latch plate 1312 away from the first latch plate 1311. The buckling bump 13121 is buckled with the board end connector 2. FIG. 5 is an usage state diagram of a cable end connector of one embodiment of the present disclosure. As shown in the figure, when the cable end connector 1 is connected to the board end connector 2, the buckling bump 13121 is connected to the buckling hole 21 of the board end connector 2. In this way, the first latch plate 1311 of the latch 131 is connected to the buckling hole 1211 of the insulating body 12 through the latch elastic sheet 13111, and the second latch plate 1312 is connected to the buckling hole 21 of the board end connector 2 through the buckling hump 13121 to achieve two-way buckling. Thus, the latch component 13 could be firmly connected to the cable end connector 1 and the board end connector 2.

In one embodiment, the first latch plate 1311 further comprises an elastic sheet retaining hole 13112. The buckling elastic sheet 13111 is disposed on one side of the elastic sheet retaining hole 13112 close to the plugging surface 12*a* and is disposed in the elastic sheet retaining hole 13112. When the latch 131 starts entering the latch accommodating groove 121, the buckling elastic sheet 13111 is pressed by the bottom surface of the latch accommodating groove 121 and enters the elastic sheet retaining hole 13112. When the buckling elastic sheet 13111 moves to the buckling hole 1211, the buckling elastic sheet 13111 stops being compressed and enters the buckling hole 1211. Thus, the latch 131 can be easily installed in the latch accommodating groove 121 through the elastic sheet retaining hole 13112.

In one embodiment, the cable end connector 1 further comprises two positioning bumps 14 oppositely disposed on the plugging surface 12*a*, guiding the cable end connector 1 to connect with the board end connector 2 allowing the cable end connector 1 to be accurately plugged into the board end connector 2. The two positioning bumps 14 are disposed on an inner side edge of the plugging surface 12*a*. Thus, the surface area that the cable end connector 1 mates with the board end connector 2 could be maintained unexceeding the area of the plugging surface 12*a* of the insulating body 12, which limits the increase of the volume of the cable end connector 1. Each of the positioning bumps 14 comprises a first positioning bump 141 and a second positioning bump 142. The second positioning bump 142 is connected to the first positioning bump 141 to form an L-shaped positioning bump 14. The extending direction of the first positioning bump 141 is parallel to the first surface 12*b*. The extending direction of the second positioning bump 142 is orthogonal to the first surface 12*b*. The two positioning bumps 14 of this embodiment are symmetrically disposed relative to the centerline of the plugging surface 12*a*. Two first positioning bumps 141 are oppositely disposed, and the two second positioning bumps 142 are also oppositely disposed. When the cable end connector is connected to the board end connector 2, the two positioning bumps 14 are inserted into two positioning slots 22 of the board end connector 2. The two first positioning humps 141 can position the height position of the cable end connector 1 on the board end connector 2. The two second positioning bumps 142 can position the width position of the cable end connector 1 on the board end connector 2. In this way, the plugging member 10 of the cable end connector 1 can be aligned with a slot 23 of the board end connector 2, and the cable end connector 1 and the board end connector 2 can be accurately connected.

Figure 6:
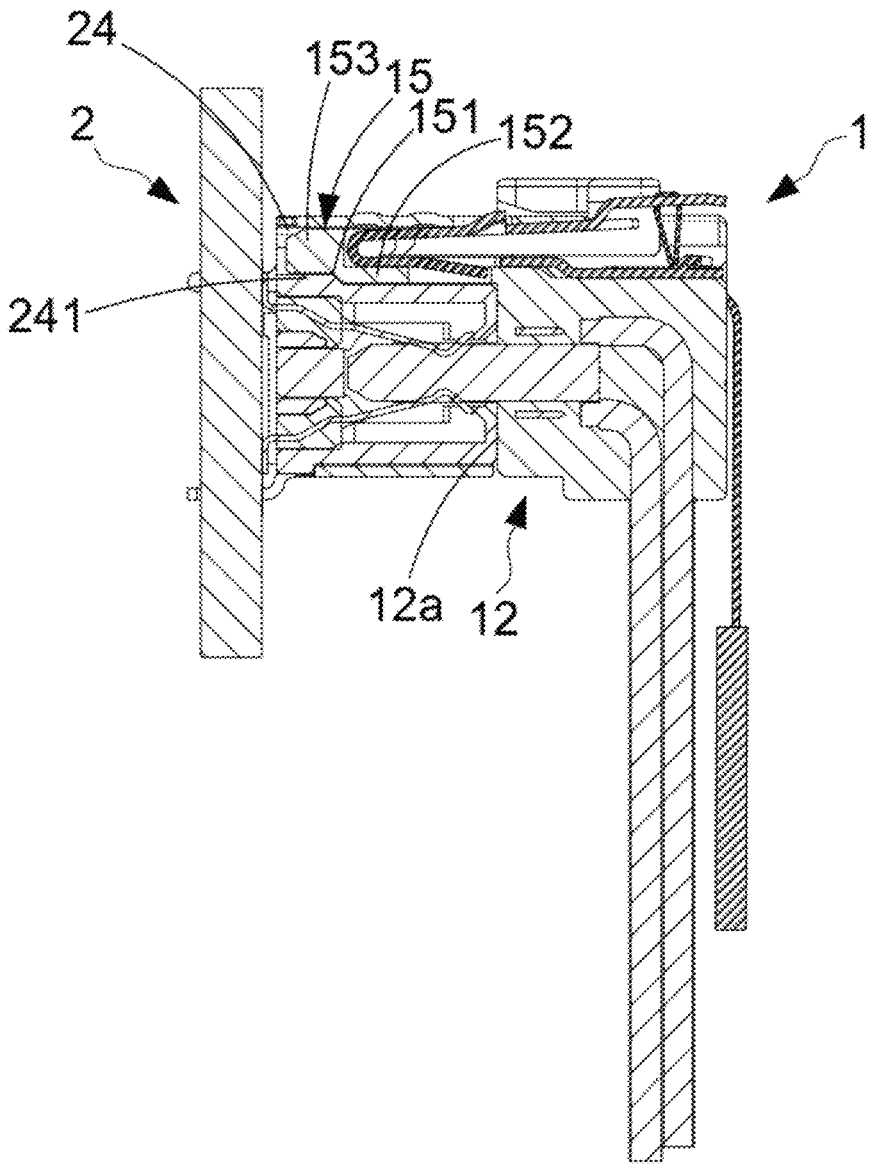
FIG. 6 is a cross-sectional view of the connection of a cable end connector and a board end connector of one embodiment of the present disclosure.

In one embodiment, the cable end connector 1 further comprises a guiding member 15 disposed on the plugging surface 12*a*, i.e., on the inner side edge of the plugging surface 12*a*. The guiding member 15 guides the cable end connector 1 to mate with the board end connector 2. In this embodiment, the guiding member 15 is disposed between the two positioning bumps 14. The length of the guiding member 15 protruding from the plugging surface 12*a* is greater than the length of the positioning hump 14 protruding from the plugging surface 12*a*. FIG. 6 is a cross-sectional view of the connection of a cable end connector and a board end connector of one embodiment of the present disclosure. As shown in the figure, when the cable end connector 1 connects to the board end connector 2, the guiding member 15 of the cable end connector 1 is first inserted into a guiding groove 24 of the board end connector 2. The guiding member 15 of the cable end connector 1 cooperates with the guiding groove 24 of the board end connector 2 to achieve preliminary positioning, which makes the plugging direction of the cable end connector 1 correct. Then, the positioning bump 14 of the cable end connector 1 is plugged into the positioning slot 22 of the board end connector 2. With the two stage positioning with guiding, damage due to oblique plugging can be avoided when the cable end connector 1 and the board end connector 2 are connected.

In one embodiment, the guiding member 15 comprises a limiting notch 151 disposed on one side of the guiding member 15 away from the plugging surface 12*a* and a surface of the guiding member 15 close to the plugging member 10, In other words, the guiding member 15 comprises a guiding body 152 and a guiding part 153. The guiding body 152 is connected to the insulating body 12. The guiding part 153 is connected to one side of the guiding body 152 away from the insulating body 12. The thickness of the guiding part 153 on a direction perpendicular to the first surface 12*b* is thinner than the thickness of the guiding body 152 on a direction perpendicular to the first surface 12*b*. So, the limiting notch 151 can be formed on one side of the guiding member 15 away from the plugging surface 12*a*. In this embodiment, a surface of the guiding body 152 close to the first surface 12*b* and a surface of the guiding part 153 close to the first surface 12*b* are on the same horizontal plane. A surface of the guiding body 152 away from the first surface 12*b* and a surface of the guiding part 153 away from the first surface 12*b* are not on the same horizontal plane. In this way, a limiting notch 151 is formed on the guiding member 15 away from the first surface 12*b*. When the cable end connector 1 is connected to the board end connector 2, the guiding member 15 is plugged into the guide groove 24 of the board end connector 2, and a limiting block 241 in the guiding groove 24 is disposed in the limiting notch 151, allowing the plugging member 10 of the cable end connector 1 to be accurately plugged into the slot 23 of the board end connector 2 for a secondary guidance positioning. In one embodiment, the latch accommodating groove 121 is extendingly disposed on one side of the guiding member 15, and the guiding member 15 is penetrated, presenting a buckling hole 1211.

In one embodiment, the cable end connector 1 further comprises two limiting members 16. The two limiting members 16 are disposed on the first surface 12*b* of the insulating body 12 and are disposed on two sides of the latch accommodating groove 121. Each of the limiting members 16 comprises a limiting groove 161, and the opening direction of the limiting groove 161 faces the plugging surface 12*a*. When the cable end connector 1 is connected to the board end connector 2, the buckling member 25 of the board end connector 2 is plugged into the limiting groove 161 of each of the limiting members 16 to ensure that the plugging direction of the buckling member 25 is correct. Thus, the buckling bump 13121 of the second latch plate 1312 of the latch 131 can be accurately buckled into the buckling hole 21.

In one embodiment, each of the limiting members 16 comprises a limiting bump 162 disposed on the latch accommodating groove 121. When the latch 131 is disposed in the latch accommodating groove 121, the second latch plate 1312 is disposed between the limiting bump 162 and the latch accommodating groove 121.

In one embodiment, the latch accommodating groove 121 comprises two opposing first latch positioning parts 1212 disposed on one side of the insulating body 12 away from the plugging surface 12*a*. In this embodiment, each of the first latching positioning parts 1212 is a groove body, of which the opening is facing a direction away from the plugging surface 12*a*. The first latch plate 1311 comprises two opposing positioning parts 13116 disposed at one end of the first latch plate 1311 away from the bent connecting sheet 1313. When the latch 131 is disposed in the latch accommodating groove 121, each of the positioning parts 13116 of the first latch plate 1311 enters the corresponding first latch positioning part 1212 to position the first latch plate 1311 in the latch accommodating groove 121.

In one embodiment, the first latch plate 1311 comprises two opposing interfering parts 13113. When the latch 131 is disposed in the latch accommodating groove 121, the two interfering parts 13113 of the first latch plate 1311 interfere with two opposing sidewalls of the latch accommodating groove 121 to secure the first latch plate 1311 in the latch accommodating groove 121.

In one embodiment, the latch accommodating groove 121 further comprises a second latch positioning part 1213, which is close to the plugging member 10 protruding from the plugging surface 12*a*. When the latch 131 is disposed in the latch accommodating groove 121, the bent connecting sheet 1313 of the latch 131 is disposed in the second latch positioning part 1213. In other words, the second latch positioning part 1213 is positioned at the position of the bent connecting sheet 1313 in the latch accommodating groove 121.

In one embodiment, the first latch plate 1311 comprises a puller perforation 13114 disposed at one end of the first latching plate 1311 away from the bent connecting sheet 1313. The second latch plate 1312 comprises a puller securing part 13122 disposed at one end of the second latch plate 1312 away from the bent connecting sheet 1313. One end of the puller 132 is secured to the puller securing part 13122, while the other end passes through the puller perforation 13114 and protrudes from the latch accommodating groove 121. Thus, the puller 132 is disposed on one side of a surface of the insulating body 12 opposite to the plugging surface 12*a*.

In one embodiment, the latch accommodating groove 121 also comprises a puller retaining notch 1214. The puller retaining notch 1214 is disposed on the bottom surface of the latch accommodating groove 121 and corresponds to the puller perforation 13114 of the first latch plate 1311. When the other end of the puller 132 passes through the puller perforation 13114, the other end of the puller 132 enters the puller retaining notch 1214, and protrudes from the latch accommodating groove 121 through the puller retaining notch 1214. In this way, the puller 132 is prevented from being sandwiched between the bottom surface of the latch accommodating groove 121 and the first latch plate 1311, and the puller 132 can be pulled without obstruction.

In one embodiment, the first latch plate 1311 comprises an anti-friction member 13115. The anti-friction member 13115 is disposed on a side edge of the puller perforation 13114 away from the plugging surface 12*a* and is disposed between the first latch plate 1311 and the second latch plate 1312. The surface of the friction member 13115 facing the inside of the puller perforation 13114 is an arc surface. The puller 132 abuts against a surface of the anti-friction member 13115 facing the inside of the puller perforation 13114. Thus, the probability of the puller 132 being fractured by friction can be effectively reduced.

In one embodiment, when unlatching through the puller 132, the puller 132 is pulled to steadily move under the guidance of the arc surface of the anti-friction member 13115. The puller securing part 13122 is driven downward by the puller 132 to lower the height of the buckling bump 13121, thereby the second latch plate 1312 and the buckling hole 21 of the board end connector 2 are unlocked. Further, the puller 132 can be pulled to detach the cable end connector 1 from the board end connector 2.

In summary, the present disclosure provides a cable end connector performing two-way buckling by buckling the buckling elastic sheet of the first latch sheet to the buckling hole of the insulating body and by buckling the buckling bump of the second latch sheet, which increases the connect stability of the latch component. By disposing two positioning bumps on the plugging surface mating with the board end connector, the two positioning bumps are disposed on an inner side edge of the plugging surface. Thus, the surface area that the cable end connector mates with the board end connector could be maintained unexceeding the area of the plugging surface of the insulating body, which limits the increasing of the volume of the cable end connector.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A cable end connector, comprising:

a plugging member comprising a plurality of contacting pads disposed on one end of the plugging member;

a plurality of cables, one end of which being disposed at the other end of the plugging member, the plurality of cables being electrically connected to the corresponding contacting pads respectively;

an insulating body comprising a plugging surface, a first surface and a connecting surface, the first surface being orthogonal to the plugging surface, one end of the plugging member with the plurality of contacting pads protruding from the plugging surface, the other end of the plurality of cables passing through the connecting surface, the first surface comprising a latch accommodating groove, the latch accommodating groove comprising a buckling hole;

a latch component disposed in the latch accommodating groove, the latch component comprising a first latch plate and a second latch plate opposite to the first latch plate, the first latch plate being adjacent to a bottom surface of the latch accommodating groove, the first latch plate comprising a buckling elastic sheet, the buckling elastic sheet projecting in a direction away from the second latch plate, the buckling elastic sheet being disposed in the buckling hole, the second latch plate comprising a buckling bump disposed on a surface of the second latch plate away from the first latch plate; and two positioning bumps oppositely disposed on the plugging surface, each of the two positioning bumps being disposed on a side edge of the plugging surface;

wherein the buckling elastic sheet extends in a direction away from the plugging surface, and one end of the buckling elastic sheet abuts against a sidewall of the buckling hole away from the plugging surface; and the first latch plate further comprises an elastic sheet retaining hole, the buckling elastic sheet is disposed on one side of the elastic sheet retaining hole close to the plugging surface, and the buckling elastic sheet is disposed in the elastic sheet retaining hole.

2. The cable end connector according to claim 1, wherein the latch component further comprises a bent connecting sheet and a puller; the bent connecting sheet is connected to one end of the first latch plate and one end of the second latch plate; one end of the puller is disposed on one end of the second latch plate away from the bent connecting sheet.

3. The cable end connector according to claim 2, wherein the first latch plate comprises two opposing interfering parts interfering with two opposite sidewalls of the latch accommodating groove.

4. The cable end connector according to claim 1 further comprises a guiding member disposed on the plugging surface; the guiding member is disposed on a side edge of the plugging surface; the guiding member is disposed between the two positioning bumps.

5. The cable end connector according to claim 2, wherein the first latch plate comprises a puller perforation disposed on one end of the first latch plate away from the bent connecting sheet; the second latch plate comprises a puller securing part disposed on one end of the second latch plate away from the bent connecting sheet; one end of the puller is disposed in the puller securing part; the other end of the puller passes through the puller perforation and protrudes from the latch accommodating groove.

6. The cable end connector according to claim 5, wherein the latch accommodating groove further comprises a puller retaining notch corresponding to the puller perforation; the other end of the puller passes through the puller retaining notch and protrudes from the latch accommodating groove.

7. The cable end connector according to claim 5, wherein the first latch plate further comprises an anti-friction member disposed on one side of the puller perforation away from the plugging surface; the anti-friction member is disposed between the first latch plate and the second latch plate.

8. The cable end connector according to claim 7, wherein a surface of the anti-friction member facing the inside of the puller perforation is an arc surface.

9. The cable end connector according to claim 2, wherein the latch accommodating groove further comprises two opposing first latch positioning parts disposed on one side of the insulating body away from the plugging surface; the first latch plate further comprises two opposing positioning parts disposed on one end of the first latch plate away from the bent connecting sheet; the two positioning parts are respectively disposed in the corresponding first latch positioning parts.

10. The cable end connector according to claim 9, wherein the latch accommodating groove further comprises a second latch positioning part; the bent connecting sheet is disposed in the second latch positioning part.

11. The cable end connector according to claim 1, wherein each of the positioning bumps comprises a first positioning bump and a second positioning bump connected to the first positioning bump; an extending direction of the first positioning bump is parallel to the first surface; an extending direction of the second positioning bump is orthogonal to the first surface.

12. The cable end connector according to claim 11, wherein the two positioning bumps are symmetrically disposed to the centerline of the plugging surface.

13. The cable end connector according to claim 4, wherein the latch accommodating groove is extendingly disposed on one side of the guiding member; the guiding member is perforated, presenting the buckling hole.

14. The cable end connector according to claim 13, wherein the length of the guiding member protruding out from the plugging surface is greater than the length of the positioning bump protruding out from the plugging surface.

15. The cable end connector according to claim 1 further comprises two limiting members disposed on the first surface; the two limiting members are disposed on two sides of the latch accommodating groove; each of the limiting members comprises a limiting groove; an opening direction of the limiting groove faces a plugging direction of the cable end connector.

16. The cable end connector according to claim 15, wherein each of the limiting members further comprises a limiting bump disposed in the latch accommodating groove; the second latch plate is disposed between the limiting bump and the accommodating groove.

* * * * *